US005140924A

United States Patent [19]

Dixon

[11] Patent Number: 5,140,924

[45] Date of Patent: * Aug. 25, 1992

[54] ELEVATING STERN PLATFORM FOR SWATH VESSELS

[76] Inventor: John D. Dixon, 620 Solar Isle, Ft. Lauderdale, Fla. 33301

[ * ] Notice: The portion of the term of this patent subsequent to Oct. 25, 2008 has been disclaimed.

[21] Appl. No.: 593,030

[22] Filed: Oct. 5, 1990

[51] Int. Cl.[5] ..... B63B 17/00

[52] U.S. Cl. ..... 114/61; 114/362

[58] Field of Search ..... 114/260, 261, 264, 265, 114/258, 259, 65 R, 286, 343, 61, 362; 182/141, 144, 145, 146, 150; 212/190, 191; 414/137.1, 137.7, 137.8, 137.9, 138.5

[56] References Cited

U.S. PATENT DOCUMENTS

| | | | |
|---|---|---|---|
| 2,761,571 | 9/1956 | Adams | 414/137.7 |
| 2,881,590 | 4/1959 | Zaskey | 114/258 X |
| 3,361,274 | 1/1968 | Goldman | 212/191 X |
| 3,378,101 | 4/1968 | Zeitler | 182/146 |
| 3,515,085 | 6/1970 | Auzins | 114/260 |
| 3,515,086 | 6/1970 | Auzins et al. | 414/137.7 X |
| 3,572,274 | 3/1971 | Brauer et al. | 114/260 |
| 3,673,974 | 7/1972 | Harper | 212/190 X |
| 3,756,446 | 9/1973 | Macrander | 414/137.7 |
| 3,851,728 | 12/1974 | Williams | 182/146 X |
| 3,951,236 | 4/1976 | Schreiber et al. | 182/145 X |
| 4,068,737 | 1/1978 | Lenz | 182/146 X |
| 4,085,695 | 4/1978 | Bylo | 114/264 X |
| 4,150,635 | 4/1979 | Lloyd et al. | 212/191 X |
| 4,175,908 | 11/1979 | Andersson | 212/190 X |
| 4,312,287 | 1/1982 | Kuo | 414/137.7 X |
| 4,492,310 | 1/1985 | Weingart | 212/191 |
| 4,600,085 | 7/1985 | Gagnon et al. | 182/141 X |
| 4,747,362 | 5/1988 | Olsen et al. | 114/264 X |

*Primary Examiner*—David A. Bucci

[57] ABSTRACT

An elevating platform attaches at the stern of a small waterplane area twin hull vessel (swath) that can be raised and lowered from a position nearly level to the vessel's deck to a position nearly level to the waterline. The platform allows convenient movement of people and equipment from the deck of the vessel to the surface of the water. Such movements may be required for either immersion in the water or removal onto another vessel or shore-side structure such as a dock. The platform attaches to the trailing edge of the vessel's struts and elevates vertically along the struts to the desired level.

10 Claims, 4 Drawing Sheets

ELEVATING STERN PLATFORM FOR SWATH VESSELS

BACKGROUND

1. Field of Invention

This invention relates to small waterplane area twin hull (swath) vessels also known as semisubmerged ships, specifically to an elevating platform apparatus attaching at the stern of a swath vessel which can be raised and lowered from a position nearly level to a vessel's deck to a position nearly level to the waterline allowing convenient movement of people and equipment from the deck of the vessel to the water.

2. Description of Prior Art

Small water plane area twin hull (swath) ships also called semisubmerged ships have been developed for improved motion characteristics in high sea states often at high speeds. Many U.S. patents including U.S. Pat. No. 234,794 to Lundborg (1880), U.S. Pat. No. 3,063,397 to Boericke (1962), U.S. Pat. No. 3,623444 to Lang (1971) and U.S. Pat. No. 4,174,671 to Seidl (1979) have been granted which disclose ships of this configuration.

Each of the configurations includes submerged pontoons that are parallel to each other and the design water line, vertical struts of reduced water plane area and an upper bridging deck. Optimal performance for these vessels is when their pitch, heave and roll motions are negligible. In this mode they are "platforming."

At a critical sea state specific to each design the vessels begin to change attitude in relation to the relative wave pattern. In this mode the vessels are "contouring." Contouring is a degradation of the superior swath motion characteristics with increasing pitch, heave and roll motion and is to be avoided when possible. The limiting critical sea state of these vessels is a direct function of the clearance between the underside of the upper bridge deck and the waterline. When the local wave height exceeds this clearance the vessel must begin contouring or the underside of the bridge deck will collide with potentially damaging wave tops.

Inherent in a swath design is a requirement for the bridging deck where the crew, passengers and equipment are located to be a significant height above the waterline. For a small swath vessel of 60 to 80 feet this height might be six feet or more. For a large swath of 300 feet this height might be 25 feet or more. This is problematic where people and equipment must be moved from the working deck to the surface of the water. Such movements may be required for immersing people or equipment in the water or moving people or equipment onto another vessel or shore-side structure such as a dock.

Current solutions for moving people and equipment from the working decks of swaths or semisubmerged ships to the waterline are limited. Of the seventeen swaths operational in the world today more than half have no fixed capability for moving people and equipment to the waterline. These ships must rely on hanging rope ladders for a minimal capability required of all ships for the recovery of crewmen who have fallen overboard.

Three swaths have "moonpools" installed which are structural cut-outs on the centerline of the vessel amidships. Through these cutouts relatively heavy equipment can be lowered either by crane or by platforms secured by wire hoists. The primary advantages of moon pools are the ample deck space adjacent to the moon pool and the negligible effect on a swath's heel or trim. Moonpools carry two great costs in terms of required supporting ships structure and loss of usable enclosed deck space. The latter is especially significant for smaller swaths with limited space.

At least five swaths operational today have the capability to lift and lower equipment over the side with cranes and A-frames. This is problematic for swaths because the small water plane area provides very little hydrostatic restoring moment especially in the transverse direction. This allows the vessel to obtain large angles of heel when relatively light weight equipment is cantilevered off to one side of the vessel.

None of the swaths operational today have satisfactory systems for moving divers or swimmers from the deck to the waterline frequently and efficiently. Commercial divers are lowered on platforms suspended by cranes or inside diving bells also suspended by cranes. No swaths operational today have any system for moving recreational divers and swimmers from the deck to the waterline.

Existing monohull technology is insufficient in providing solutions. Various swim platforms developed for smaller vessels such as those in U.S. Pat. No. 3,613,137 by Eccles (1971), U.S. Pat. No. 3,857,127 by Hedrickson (1974), U.S. Pat. No. 4,462,485 by Terry and Ritten (1984) and U.S. Pat. No. 4,548,155 by Hegg et al. (1985) utilize platforms attached to the transom or side at a fixed height. For a swath, the platform needs to be at the waterline only when the vessel is stopped and people or equipment need to be moved from the deck to the waterline. Before the vessel gets underway the platform must be removed or elevated so that waves passing under the bridge deck will not wash the platform away.

Extensible ladders have been proposed such as in U.S. Pat. No. 3,774,720 by Hovey (1973), U.S. Pat. No. 4,538,314 by Baranowski (1985), U.S. Pat. No. 4,733,752 by Sklar (1988), U.S. Pat. No. 4,724,925 by Ritten (1988), and U.S. Pat. No. 4,823,910 by Day (1989). For even the smallest swath the ladder required would have to be cantilevered from the hull six feet before becoming subject to wave forces. Such a configuration would require either a hinged ladder or excessive support structure.

Numerous accommodation ladder designs have been developed such as those disclosed in U.S. Pat. Nos. 3,841,439 and 3,856,110 by P. Nilsson (1974), U.S. Pat. No. 4,043,288 by Vulovic (1977), U.S. Pat. No. 4,115,887 by Ewards (1978) and U.S. Pat. No. 4,363,150 by E. Nilsson (1982). All of these designs used the expansive sides of a large ship for attachment and operation. For a swath the stern is the preferred location as the longitudinal hydrostatic stability of the swath configuration is inherently greater than the transverse hydrostatic stability resulting in less trim than heel for the same moment due to eccentric loading.

In U.S. Pat. No. 4,085,473 Franklin (1978) discloses a deck platform extension for boats utilizing a removable deck platform which attaches to the transom of a monohull at a fixed height with triangular support braces on the bottom side. The platform is not height adjustable nor is it designed to allow people or equipment to disembark onto a dock or second vessel or enter the water.

In U.S. Pat. No. 4,166,517 Henderson (1979) discloses a power elevator utilizing a cab guided along two tracks attached to the flat expansive side of the ship from the deck to the waterline and a winch and cable for raising and lowering. This idea would be difficult to implement on a swath since flat sides are usually nonexistent. The winch and cable means for moving the cab up and down could be improved on because of the inability of the cable to carry loads in compression. After the cab is lifted by a passing wave it will drop down to its original position and stop abruptly at the end of the cable run shock loading the cable and passengers. The cab can also be improved on by enlarging it allowing more people and a variety of equipment.

OBJECTS AND ADVANTAGES

Several objects and advantages of the present invention are:

(a) to provide a platform which is substantial in size having a width approaching that of the vessels's beam and a length restricted only by the size of the supporting cantilevered beams;

(b) to provide a platform whose positioning is at the stern rather than to a side of a swath vessel so advantage is made of the swath configurations higher hydrostatic stability in the longitudinal direction than in the transverse direction;

(c) to provide a platform which can be elevated vertically upwards to a position nearly level with the bridging deck to facilitate loading of people and equipment and to preclude wave impacts underway and when the vessel stops be lowered to a position nearly level with the waterline to facilitate movement of people and equipment into the water or onto a boat or dock;

(d) to provide a platform which will be rigidly supported at the chosen elevation with little or no vertical or horizontal movement even under occasional wave loading;

(e) to provide an elevating stern platform which has multiple uses including embarking passengers, crew, equipment and the like onto another vessel or dock and moving recreational divers, commercial divers, swimmers, small boat tenders, and subsea equipment and the like from the accommodation decks to the water.

Further objects and advantages are to provide a platform which will be inexpensive to fabricate, easy to maintain and simple to operate. Still further objects and advantages will become apparent from a consideration of the ensuing description and drawings.

DRAWING FIGURES

REFERENCE NUMERALS IN DRAWINGS

Figure 1:
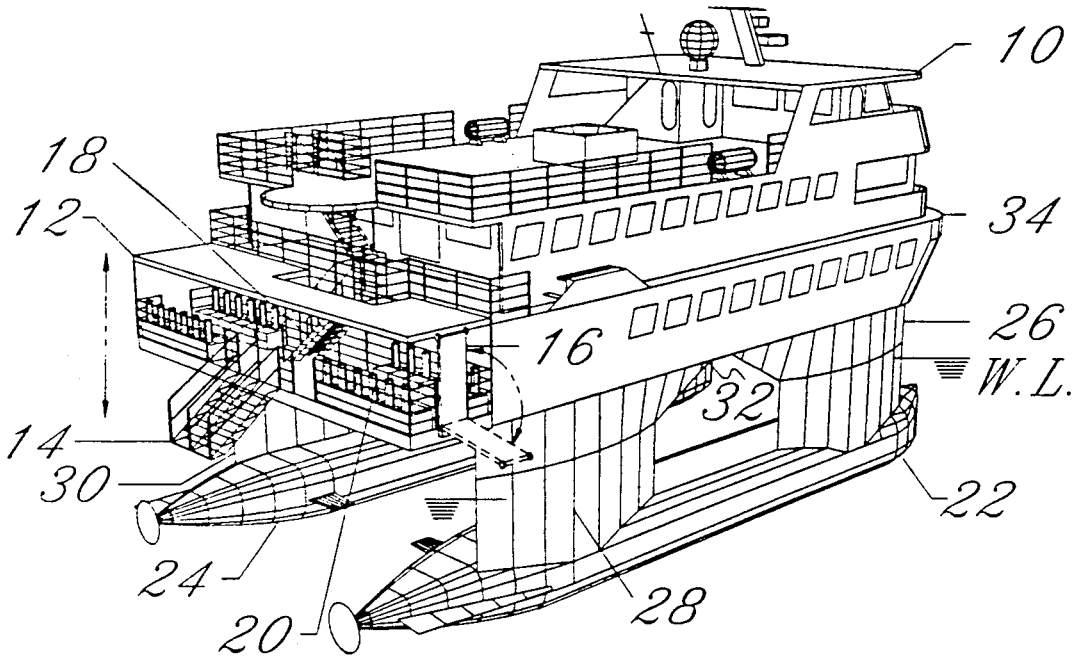
FIG. 1 is a perspective view of a swath vessel with the present invention attached.

| | |
|---|---|
| 10 swath | 12 platform |
| 14 diver boarding steps | 16 embarkation ramp |
| 18 telescoping platform steps | 20 bench/tank/gear locker |
| 22 starboard pontoon | 24 port pontoon |
| 26 forward starboard strut | 28 aft starboard strut |
| 30 aft port strut | 32 forward port strut |
| 34 bridge deck | 36 lead screw |
| 38 threaded nuts | 40 slide |
| 42 guide | 44 flexible skirt |

-continued

| | |
|---|---|
| 46 cutlass bearing | 48 stuffing tube |
| 50 bearings | 52 self-locking motor |
| 54 flange coupling | 56 angle clips |
| 58 non-metallic inserts | |

DESCRIPTION—FIGS. 1 TO 4

A small water plane area twin hull ship (swath) also called semisubmerged ship constructed in accordance with the preferred embodiment of the invention is illustrated in the drawing and generally designated 10. Swath 10 includes two parallel submerged pontoons 22 and 24 which provide stability and buoyancy support for the upper bridge deck 34 through either two, or as depicted, four struts, 26, 28, 30, 32.

Affixed to the trailing edge of the bridge deck 34 is the subject of the present invention platform 12. Platform 12 will normally be at least as wide as the distance between the centerlines of the port and starboard struts 28 and 30. Platform 12 may also have diver boarding steps 14 installed to facilitate swimmer and diver entry and exit.

Nominally located on either the port side, starboard side or both would be an embarkation ramp 16 that would extend over to a dock for loading and unloading of passengers, crew, provisions and equipment. Telescoping platform steps 18 can be installed that would allow movement from the bridge decks to the platform without the platform having to be raised. A bench-/tank/gear locker apparatus can be installed on the platform to assist divers in donning their equipment.

The waterline for a swath is normally at the half height of the struts 26, 28, 30 and 32. Usually the exact position of the waterline is variable depending on the current ballasting of the vessel. Occasionally swaths are designed with highly variable water lines to decrease the draft allowing entry into shallow water ports. The swath design allows for greatly reduced motion in a seaway. The greater the height of the bridge deck 34 over the waterline the higher the waves which may be encountered before impacting the bridge deck structure 34.

Figure 2:
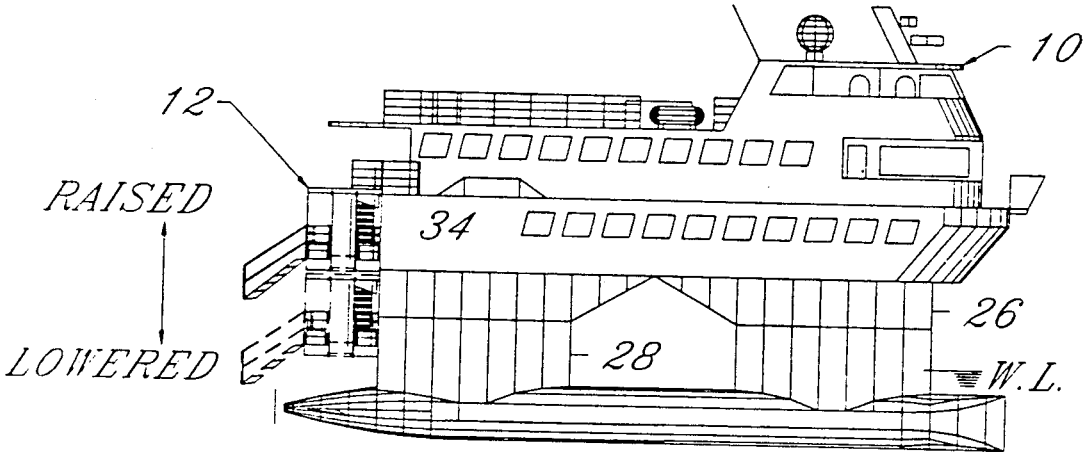
FIG. 2 is a side view of the vessel of FIG. 1 illustrating the raised and lowered position of the elevating platform.

The platform 12 elevates vertically along the trailing edge of the struts 28 and 30. When the swath vessel 10 is underway the platform 12 must be raised to the height of the bridge deck 34 so as to avoid impact with waves passing under the bridge deck 34. FIG. 2 depicts this raised position. When it is desired to have a working platform at or near the waterline, platform 12 is lowered to the desired height as depicted in FIG. 2.

Figure 3:
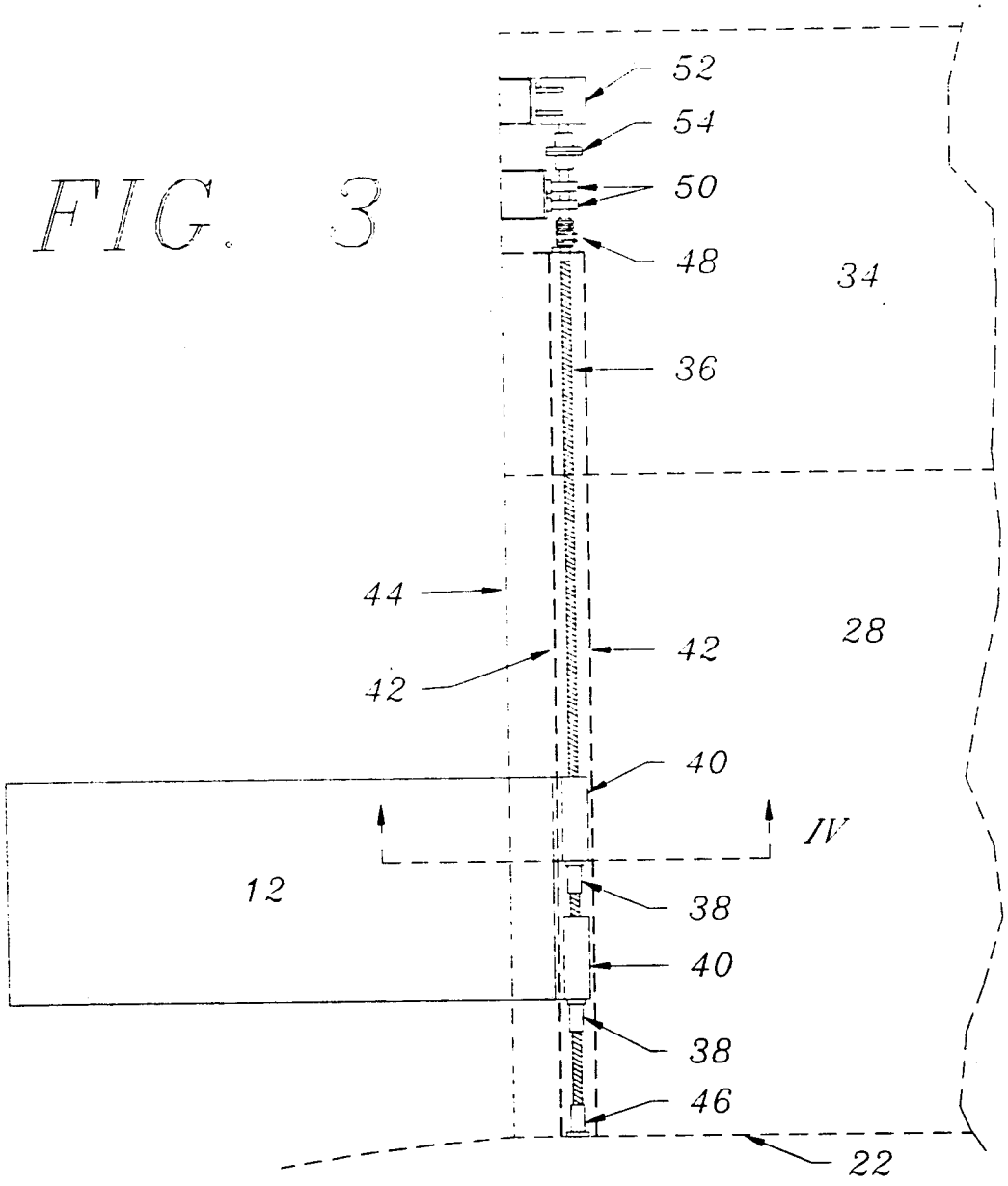
FIG. 3 is a cut-away view of the lead screw mechanism in the strut.

There are many mechanical devices that can be used to implement the invention. One such device is depicted in FIG. 3. In this embodiment a lead screw 36 consisting of a shaft with threads cut into it is vertically mounted in the trailing edge of the struts 28 and 30. Mounted on the lead screw 36 are threaded nuts 38. The lead screw 36 and the threaded nut 38 support the vertical axial load of the platform 12. The moment of the cantilevered platform 12 and any transverse loads are supported by the slide 40 and guide 42. The platform 12 is bolted to the slide 40 which is pinned to the top of the threaded nuts 38. To improve water flow around the guide 42 a flexible skirt 44 is installed.

The foot of the lead screw 36 is secured by a free flooding cutlass bearing 46. The lead screw 36 enters the hull at the top of the guide through a stuffing tube 48 maintaining water tight integrity of the vessel. Bearings 50 are used to support the upper end of the lead screw 36 and transmit the axial load to the hull. A self locking motor 52 either hydraulic or electric is used to turn the lead screw 36 for lowering or raising the platform 12. A flange coupling 54 would normally be used to connect the self locking motor 52 and the lead screw 36.

Figure 4:
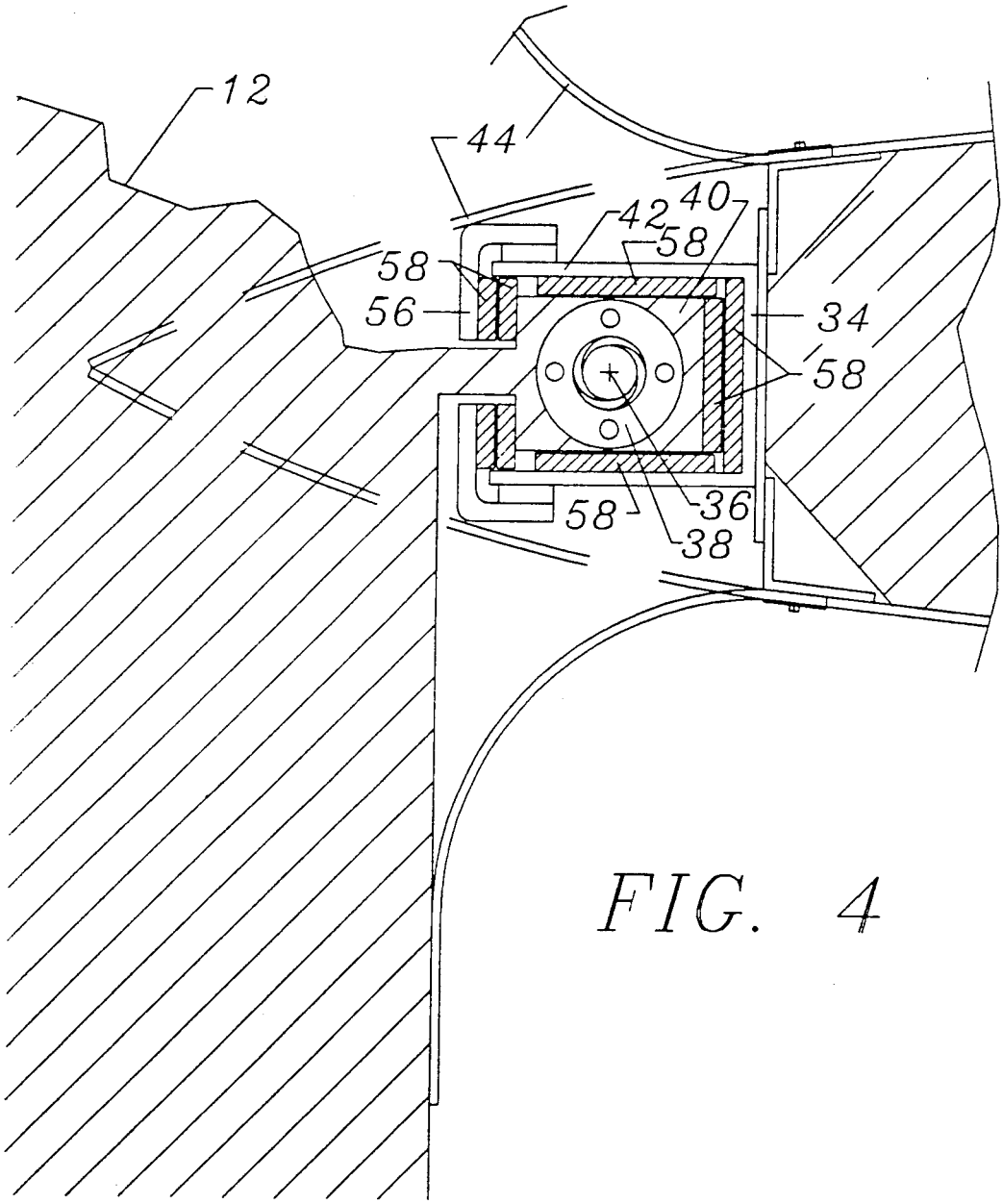
FIG. 4 is a cross section of the lead screw, threaded nut, slides and guide.

FIG. 4 shows a cross section of the lift assembly including the lead screw 36, threaded nut 38, slide 40, guide 42 and flexible skirt 44. Angle clips 56 are bolted to the guide 42 to lock the slide 40 in place. Removal of the angle clips 56 provides access to the lead screw 36, slide 40 and guide 42 for inspection, maintenance and removal. Non-metallic inserts 58 are used between the metallic slide 40 and the metallic guide 42 to reduce friction and to reduce wear and corrosion on the metallic slide 40 and metallic guide 42.

OPERATION—FIGS. 1 TO 4

The manner of using the elevating stern platform consists of flooding the swath 10 ballast tanks such that the waterline is either at the midheight of the struts 26, 28, 30 and 32 or at the upper edges of the pontoons 22 and 24 or between those two drafts. Many swaths are designed for this variable mode of operation so that the deeper draft of the normal operating depth does not preclude the vessel from entering shallow draft harbors.

During normal open ocean transit the swath 10 is ballasted down such that the waterline is at the midheight of the struts 26, 28, 30 and 32. Waves encountered by the swath 10 will pass over the pontoons 22 and 24 and under the bridge deck 34 with a negligible effect on the vessel's motion. In this condition the platform 12 would normally be elevated to its upper most position to keep it from the path of passing waves.

There are at least three scenarios for utilization of the platform 12. The first would be to put commercial divers or recreational divers and swimmers in the water. In this case the swath 10 would come to a complete stop, secure engines and lower the platform from its raised position to a lowered position directly above the waterline. Divers and swimmers would either ride down on the platform 12 or walk down the telescoping platform steps 18.

The platform 12 may be equipped with bench/gear/-tank locker 20 arrangement for assisting the diver with equipment preparation. Once the diver is suited up he may either step off the platform 12 or walk down a set of diver boarding steps 14. When the diver or swimmer has completed their activity they would proceed back up the diver boarding steps 14 onto the platform 12 and either ride the platform 12 up to the bridge deck 34 or walk up the telescoping platform steps 18.

A second scenario would be for passengers desiring to board a dock or second vessel alongside the swath 10. In this case one or both sides of the platform would be equipped with an embarkation ramp 16. The platform 12 would be lowered until the embarkation ramp 16 could be extended to the dock or the dock or second vessel was close by alongside.

A third scenario would be for the deployment of equipment such as submersibles, surface craft, remotely operated vehicles and the like. In this case the platform 12 might be lowered until it was submerged and the equipment immersed gaining buoyancy.

The lowering of the platform 12 would consist of energizing the self-locking motor 52 to begin turning the lead screw 36 in the direction corresponding to the desired direction of platform travel. As the lead screw 36 rotates the threaded nuts 38 traverse the lead screw 36 vertically carrying with them the slide 40. The lead screw 36 is sized to support all of the axial load of the platform 12 in both static and dynamic conditions in addition to friction of the threaded nuts 38 over the lead screw 36 and the slide 40 within the guide 42.

The function of the slide 40 is twofold. First, the slide 40 provides a method for securing the platform 12 to the threaded nuts 38. Second, the slide 40 provides load surfaces to press against the guide 42 and the angle clip 54 surfaces. The slide 40 is enclosed within the annulus formed by the guide 42 and the angle clips 54.

All the platform 12 horizontal loads in both the longitudinal and transverse direction are supported by the slide 40 running within the guide 42 and angle clips 54. The downward moment of the cantilevered platform 12 is supported by the upper two slides 40 pressing against the angle clips 54 and the lower two slides pressing against the guide 42.

Wear pads 56 are used to reduce friction and maintenance. High surface pressures between the slides 40 and the guides 42 create friction adding considerably to the power required to turn the lead screw 36 lifting the platform 12. Petroleum based lubricants which normally might be used to reduce friction are not available in this application because of environmental considerations against exposing seawater to petroleum products. The high surface pressures would also wear away any surface coating used to protect the metallic slides 40, angle clips 54 and guide 42 from seawater induced corrosion.

The lead screw 36 is made water tight where it passes into the hull through use of a stuffing tube 48. The axial load of the lead screw is transferred to the hull through bearings 50.

A flexible skirt directed aft is installed adjacent to the shell plating for the vertical length of the trailing edges of struts 28 and 30 to fair the flow of water around the guide 42 and angle clip assembly 56. In normal transit with the platform 12 up the flexible skirt folds in due to the dynamic pressure of the water to form a V shape. As the platform 12 is lowered the flexible skirt folds outward to allow the platform 12 to pass by.

SUMMARY, SPECIFICATIONS, AND SCOPE

The present invention provides an elevating platform that attaches at the stern of a SWATH vessel and can be raised and lowered from a position nearly level to the vessel's deck to a position nearly level to the water. The platform allows convenient movement of people and equipment from the deck of the vessel to the surface of the water for immersion in the water or removal onto another vessel or shore-side structure such as a dock. The platform attaches to the trailing edge of the vessel's struts and elevates vertically along the struts to the desired level.

While other mechanical devices may be used to implement the invention such as cables, pistons, worm gears and roller guides it is understood that such changes will be within the spirit and scope of the present invention, as is defined by the appended claims.

What is now claimed is:

1. A marine craft comprising: an elevating platform rigidly attached at a transom; and means for raising and lowering said platform from a position nearly level to a deck of said marine craft to a position nearly level to a waterline wherein said means for raising and lowering includes at least one lead screw vertically coupled with rotating bearings to said transom, traversing nuts connected only to an inboard portion of said elevating platform and to said lead screw to support a vertical load of said elevating platform, and a plurality of sliding bracket mechanisms connected to said tranversing nuts ant enclosed in at least one vertically oriented guide connected to said transom to resist lateral translatory forces due to roll and pitch of said marine craft and to resist a cantilevered moment of the said elevating platform due to singular support of one side of said platform only.

2. The combination as set forth in claim 1 wherein said elevating platform includes a sloping ramp and a stair tower to allow movement of people and equipment from said deck to said elevating platform without having to raise or lower said elevating platform.

3. The combination as set forth in claim 1 wherein said elevating platform includes at least one embarkation ramp to allow movement of people and equipment from said elevating platform.

4. A semisubmerged vessel comprised of: a plurality of submerged pontoons parallel to each other and a water surface, a plurality of vertical struts and a plurality of bridge decks connected to said vertical struts and an elevating platform coupled directly to at least one of said struts by translating mechanical means for raising and lowering said elevating platform from a position nearly level to said deck to a position nearly level to a waterline whereby said platform can be conveniently located near said waterline and subsequently be elevated clear of any waves passing underneath said deck.

5. The combination as set forth in claim 4 wherein said mechanical means includes lifting and positioning devices connected to a trailing edge of said vertical struts for vertical translation and lateral support.

6. The combination as set forth in claim 5 wherein a flexible skirt is attached to said trailing edge of said vertical struts to streamline water flow around said mechanical means to reduce resistance when the vessel is underway.

7. The combination as set forth in claim 4 wherein said mechanical means includes screw vertically aligned and attached with bearing supports to said vertical struts and a transversing nut connected to said platform to support a vertical load of said platform.

8. The combination as set forth in claim 5 wherein said mechanical means includes a vertical guide assembly attached to said trailing edge of said vertical struts for resisting a cantilevered moment of said elevating platform and for supporting a lateral load.

9. The combination as set forth in claim 4 wherein said platform includes at least one stepway.

10. The combination as set forth in claim 4 wherein said platform includes at least one embarkation ramp to allow movement of passengers and crew from said platform.

* * * * *